United States Patent [19]

Neal

[11] 4,169,505

[45] Oct. 2, 1979

[54] KICK-OVER APPARATUS

[76] Inventor: William C. Neal, Rte. 2, Box 23-B, Houston, Tex. 70345

[21] Appl. No.: 950,121

[22] Filed: Oct. 10, 1978

[51] Int. Cl.[2] ..... E21B 7/06

[52] U.S. Cl. ..... 166/117.5; 166/241

[58] Field of Search ..... 166/117.5, 241; 308/4 A

[56] References Cited

U.S. PATENT DOCUMENTS

| | | | |
|---|---|---|---|
| 2,856,008 | 10/1958 | Spencer | 166/117.5 |
| 2,895,428 | 7/1959 | Regan et al. | 166/117.5 |
| 2,899,633 | 8/1959 | Smith et al. | 166/241 |
| 3,555,689 | 1/1971 | Cubberly, Jr. | 166/241 |
| 3,828,853 | 8/1974 | Neal | 166/117.5 |

*Primary Examiner*—James A. Leppink
*Attorney, Agent, or Firm*—Gunn & Lee

[57] ABSTRACT

A kick-over tool is disclosed, the preferred embodiment supporting a tool in installing or removing sidepocket-located gas-lift valves. The kick-over tool incorporates, describing it from the upper end, a detent mechanism which locks a sliding sleeve, the sleeve extending over a deflectable knuckle permitting the tool to bend and thereby extend into a sidepocket, and a set of bow springs extending longitudinally of the tool. The sleeve has lengthwise windows cut in it, permitting the bow springs to extend outwardly or to be collapsed. The bow springs are collapsed by the sleeve when the sleeve strikes them in the center portion. They are mounted at each end on support anchor devices which slide along a mandrel. Coil springs urge the bow springs to a bowed position. The apparatus functions on jarring movement which inertially upsets the sleeve downwardly to unlock the knuckle and extend the bow springs outwardly. The bow springs are confined by the wall of the drill string, except adjacent to a sidepocket which deflects the lower portion of the tool into the sidepocket and thereby positions equipment for installation or retrieval of a gas-lift valve into or out of the sidepocket.

4 Claims, 4 Drawing Figures

FIG. 1
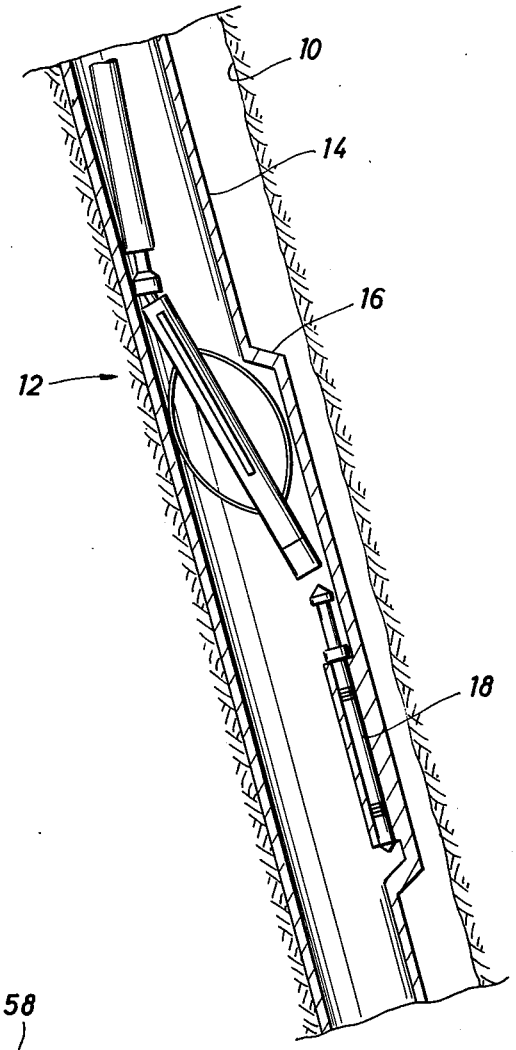
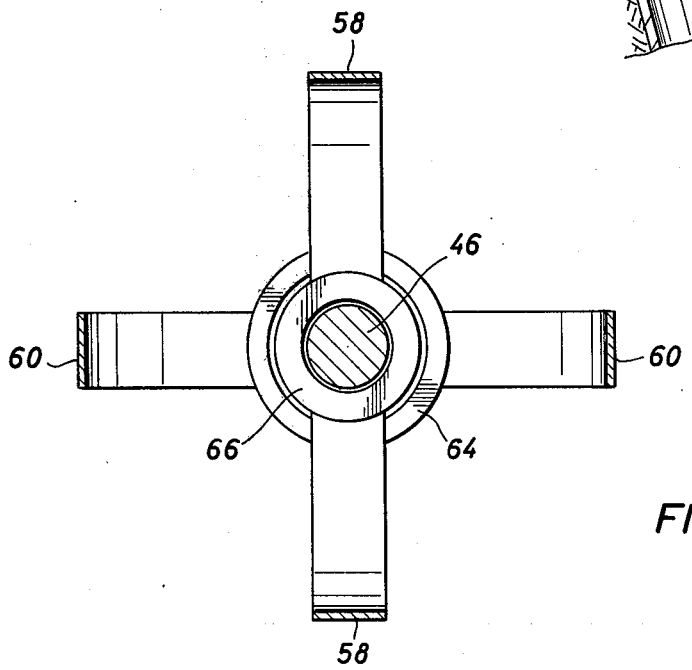
FIG. 4

KICK-OVER APPARATUS

BACKGROUND OF THE INVENTION

Many oil and gas wells have sufficient downhole pressure to flow to the surface. Others, however, require production utilizing gas-lift methods. Gas-lift valves are installed in a string of production tubing at specified elevations in the well. Ordinarily, gas-lift valves are physically located in sidepockets on the tubing string. Sidepockets are off to the side of the main axis of the tubing string. Production is achieved by introducing gas through a gas-lift valve into the production tubing string. Sometimes, however, gas-lift valves fail and require servicing in some form or fashion. They must be removed or replaced. In wells which are slanted, there is some difficulty in locating a sidepocket because the natural path of movement of a retrieval or installation tool is centered along the axis of the tubing string but hangs toward the vertical. Moreover, an operator at the surface who is manipulating a retrieval tool on a wireline does not know the precise azimuthal location of a sidepocket, even when he does known the relative elevation. Consider an easy example. Suppose a surface operator knows that a sidepocket is located at 5,000 feet in the well. The sidepocket may be located on the north side of the well. The well at this depth may, additionally, be a slant hole, slanting by ten degrees to the east. Such precise location of the sidepocket is usually not readily known, and, even when available, it is difficult to manipulate the angular orientation of valve installation equipment on a wireline.

The present inventor previously devised a kick-over tool disclosed in U.S. Pat. No. 3,828,853. That apparatus is believed to be functioning quite nicely. It operates nicely in vertical wells, as well as those which are deviated or slant wells. It particularly causes the retrieval tool to kick over into the sidepocket. Applicant's prior structure utilizes four bow springs which are freed for expansion at the time of retrieval or installation. When the four bow springs are released, all of the springs are confined, except a bow spring which forces the lower end of the tool to deflect into the sidepocket. This apparatus, while quite successful, normally contemplates expansion of four low springs. The four bow springs cannot all expand; expansion is limited by the relief permitted to the lower end of the tool as the kick-over tool deflects into the sidepocket.

The present invention is an improvement over the prior apparatus of applicant. The prior apparatus has functioned quite nicely and continues to do so. However, this invention goes one step further in the provision of dual coil springs which initiate kick-over. The coil springs work against pairs of the bow springs to deflect them outwardly. Ordinarily, dimensions are such that only a pair of bow springs will be permitted to fully deflect. Only one pair of bow springs normally has room to expand and deflect when the sidepocket is located. Conversely, the other two bow springs, which are located at ninety degrees with respect to the first pair, are not permitted to expand or deflect. In other words, it is inevitable in practically every dimensional situation that two of the springs will deflect outwardly to the maximum permitted, while the other two springs will deflect outwardy only by a short distance. Their deflection is constrained by the limitations of space. Assume, for examle, that the tubing string is $2\frac{7}{8}$ inch nominal size. If the tool, itself, is about two inches in diameter, one pair of opposing bow springs will deflect by only about one-half inch for each of the two bow springs. The other two bow springs will deflect by two or three times, or more. This results in some variation of the length of the bow springs after deflection. The present invention utilizes two coil springs to accommodate such deflections and, particularly, variations in deflection.

BRIEF SUMMARY OF THE INVENTION

The invention disclosed incorporates a threaded connection at the top end which is adapted to be connected with a jar and a rope socket mechanism thereabove. This permits the tool to be run into a tubing string on a wireline and, particularly, even into deviated gas-lift wells. At the upper end, the tool includes a spring-operated detent for latching a sleeve. The sleeve is on the exterior. The sleeve locks over a knuckle which can deflect, thereby enabling the lower portions of the tool to extend at an angle into a sidepocket. The sleeve locks the knuckle selectively and is maintained in the locked position by the spring-loaded detent mentioned. When the sleeve is in the up position, it extends above and below the knuckle and, thereby, locks it in a manner to prevent deflection. Below the knuckle, there is a fitting and an elongate, central mandrel. The mandrel is in the center of the tool and slidably supports a spring-urged, encircling bow spring anchor mechanism connected to the upper ends of two bow springs, there being four in the preferred embodiment, arranged at ninety degrees around the tool. The spring is a coil spring which encircles the mandrel. Four anchors are telescoped on the mandrel, and at least two are able to slide. When the sleeve is in the up position, it locates windows adjacent to the bow springs, permitting the bow springs to protrude slightly out of each window. The sleeve is a lock mechanism which is inertially driven downwardly. The sleeve positions the windows centrally of the bow springs to permit them to flex outwardly. In the up position, the sleeve locks the bow springs against deflection so that they are fairly well compressed.

The four bow springs, arranged oppositely of one another, are supported as pairs by separate pairs of anchors. Coil springs urge at least one of each pair of slidable anchors toward its mate, while the remaining pair of bow springs anchors cannot move as a result of bow spring confinement. This permits springs to deflect outwardly as required in the operation of the device.

BRIEF DESCRIPTION OF THE DRAWINGS

FIG. 1 is a view which shows a kick-over tool in accordance with the teachings of this invention in a tubing string extending at an angle into a sidepocket for installation or removal of a gas-lift valve;

FIG. 4 is a view along the line 4—4 of FIG. 3 disclosing the range of deflection of bow springs.

DETAILED DESCRIPTION OF THE PREFERRED EMBODIMENT

Figure 2:
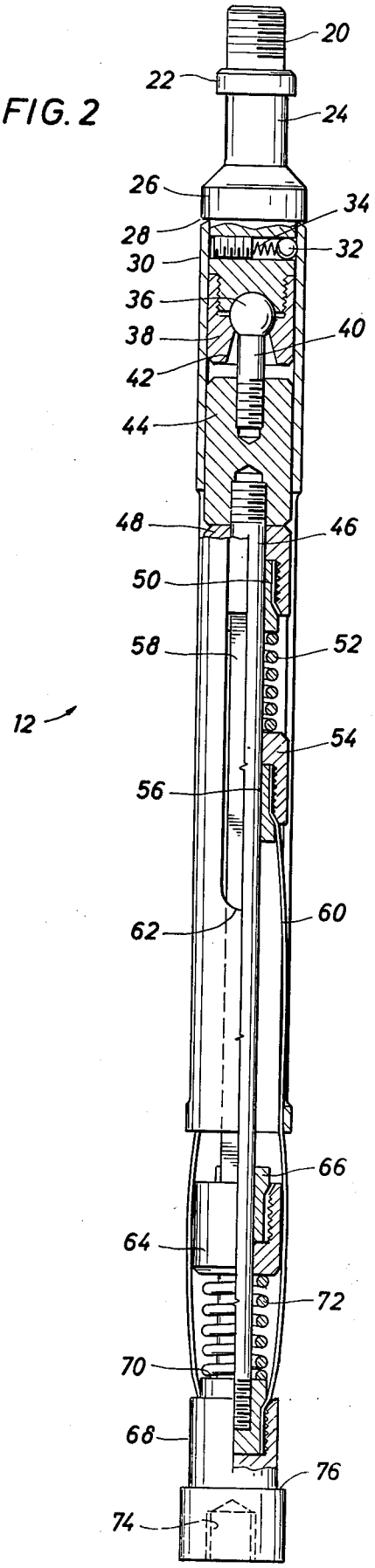
FIG. 2 is a sectional view along the length of the kick-over tool of the present invention which is momentarily arranged to be run into a well with the bow springs clamped next to the tool and wherein rotation of the knuckle is prevented by a slidable sleeve.

Attention is initially directed to FIG. 1 of the drawings. FIG. 1 shows the setting or background in which the present invention is used. In FIG. 1, a well 10, which has been drilled at an angle from the vertical, shows a production tubing string 14 in the well with the kick-over tool 12 extending toward a sidepocket 16. The sidepocket 16 receives a gas-lift valve 18. The gas-lift valve is to be installed or retrieved, as the case may be, utilizing a wireline, a jar mechanism, the kick-over tool 12 and a bottom-attached installation or retrieval tool supported by the kick-over tool. All of this equipment is run into the well on a wireline in a well known manner. The present invention can be used to install or retrieve gas-lift valves from several manufacturers, including Camco, Macco and others. The kick-over tool deflects the installation or retrieval tool into the sidepocket for the purpose of engaging the gas-lift valve. Several gas-lift valves may be located in the deviated well, and each one is handled individually, using the same equipment repetitively.

Figure 3:
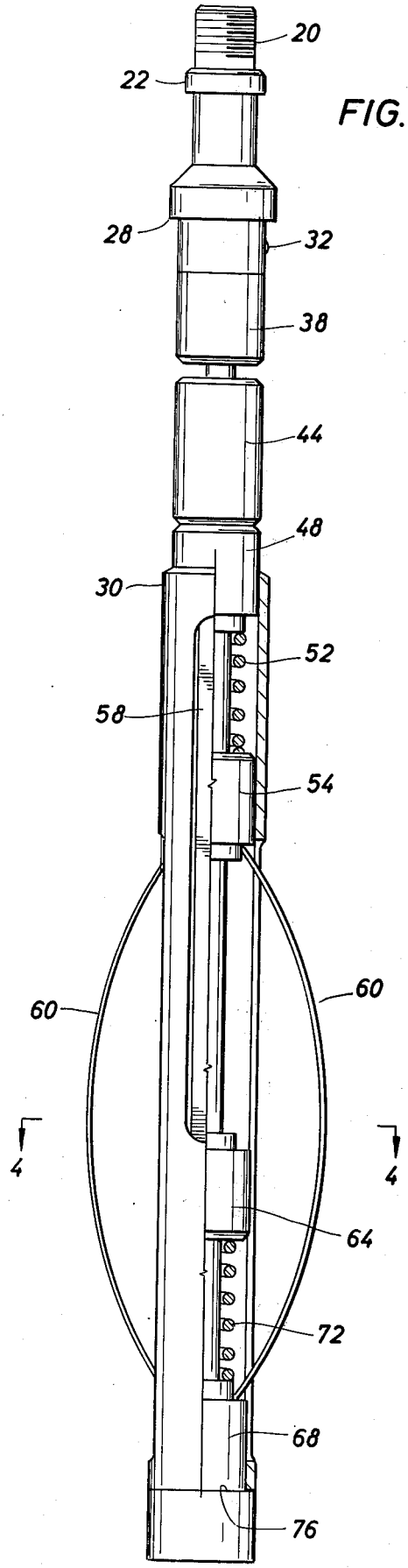
FIG. 3 is a view similar to FIG. 2 with portions broken away to show details of construction whereby a pair of bow springs have been expanded, while another pair remain unexpanded.

A better understanding of the present invention will be obtained by reference to FIGS. 2 and 3, considered jointly. The description of FIGS. 2 and 3 will proceed from the top to the bottom of the tool. The kick-over tool 12 shown in FIG. 2 incorporates an upper threaded pin end 20 which is adapted to be threaded to a jar impact tool. The threads are on the exterior and extend down to a surrounding collar 22. The collar 22 is located above a neck 24 which extends to an enlarged cylindrical member 26. The cylindrical member 26 has a downwardly facing shoulder 28. The shoulder 28 limits the upper travel of a sleeve 30. The sleeve 30 is held in the up position by means of a ball 32 which is driven by a spring 34 against the sleeve 30. The ball, sleeve and a suitable plug are received in a transversely drilled passage to operate as a detent mechanism. This prevents slippage of the sleeve. The sleeve is locked in the up position by the detent. The sleeve 30 is selectively moved downwardly against the resistance imposed by the detent mechanism. This movement is accomplished at a time and in a manner to be described.

The cylindrical body 26 is externally threaded and is drilled with a semicircular, dished-out area at its lower portions to receive a spherical enlargement 36 which functions as a knuckle. The enlargement 36 is captured by a surrounding, axially hollow, threaded nut 38. The nut 38 captures the enlargement 36. The enlargement 36 is captured above the nut 38 and held against the semicircular seat provided for it. The sphere 36 is able to wobble or rotate. Its range of movement is determined by a shaft 40 which is received in a conic, axial passage 42 drilled into the nut 38. When the sleeve 30 is down, the knuckle permits angular deflection of the lower part of the kick-over tool 12. In the up position of FIG. 2, the sleeve 30 locks against angular deflection. The shaft 40 is threaded and is joined to a cylindrical sub 44. It will be observed that there is a space or gap between the cylindrical sub 44 and the nut 38. It will be further observed that the cylindrical sub 44 is sized to fit snugly within the sleeve 30.

The sub 44 anchors an elongate mandrel 46. The mandrel 46 is threaded into a suitably drilled and tapped opening in the sub 44. The mandrel 46 extends through the center of the tool and positions and locates most of the equipment to be described. It particularly provides means for aligning the bow springs anchor mechanisms which will be described. The mandrel 46 receives and supports, on its exterior, a large, ringlike anchor mechanism 48. The anchor mechanism 48 is a hollow ring which slides on the mandrel and which is jammed upwardly. The anchor nut 48 is centrally hollow and is drilled with a countersunk bore. It is internally threaded. A lock sleeve 50 is threaded into it, and the two thread together. However, they do not thread together fully around their circumference. FIG. 2 shows a gap between the members 48 and 50 such that the gap will receive the tip of a bow spring to be locked in position. It will be observed that the gap between the two members is able to receive and lock a bow spring in position by bending the tip slightly. This enhances the locked condition of the bow spring.

The circular members 48 and 50 which comprise the first spring anchor mechanism support two bow springs. These bow springs will be described conveniently as the north and south bow springs. This is an arbitrary designation and will be distinguished from east and west bow springs, to be described later.

The first bow spring anchor mechanism is slidably located around the mandrel 46, and it is always at the top end of the mandrel. It is forced upwardly by a coil spring 52. The coil spring 52 bears against a second, slidably mounted bow spring anchor mechanism. The second is very similar to the first. The second includes a large outer ring 54 and a smaller internal sleeve 56. These two function together, again, with a gap between them, so that the east and west bow springs are anchored. The numeral 58 identifies a north bow spring, while the numeral 60 identifies the east and west bow springs.

Bow springs 58 are, thus, supported at the first bow spring anchor mechanism, while bow springs 60 are supported by the second bow spring anchor mechanism. The sleeve 30 surrounds all four bow springs, and, ideally, the four bow springs are located at ninety degree positions relative to one another. The sleeve 30 further incorporates elongate ports or windows 62 for all four bow springs. These ports have a length and width which enables the bow springs to stick out slightly. As shown in FIG. 2, the bow spring 60 does not protrude so far as to be able to drag until it is released. Conversely, it does bow outwardly enough to maintain alignment in the window. This enables it to expand from the equipment on actuation. The sleeve 30 is, thus, a clamp mechanism. In FIG. 2, it will be observed that the sleeve 30 clamps all four of the bow springs. They are clamped, notwithstanding their position adjacent to windows cut in the sleeve which will permit them to controllably bow or extend through the windows. The north bow springs 58 terminate at a third circular anchor mechanism. This includes an external tubular sleeve 64 which slides about the mandrel 46 and an internal threaded sleeve 66 which threads to it. Again, a gap is defined between the threads to enable the tip of the bow spring to be captured and pinched between the two members as they are threaded together. The members 64 and 66, together, telescope up and down on the mandrel 46.

The bow springs 60 extend from the second anchor mechanism to the fourth anchor mechanism. The bow spring 60 is, thus, captured between the outer tubular sleeve 68 and the inner tubular sleeve 70. These two members thread together and define a gap between them to pinch and lock the tip ends of a pair of opposing bow springs.

The threaded member 70 could be movable, but it is not necessary that it be movable. Indeed, it serves as a fixed bottom anchor for the mandrel 46 which is threaded to it. It has a transverse, upwardly facing shoulder, and a coil spring 72 is positioned between the third and fourth anchor mechanisms. The coil spring 72 forces them apart. The coil spring, thus, bears on one pair or the other of the bow springs. As will be observed, the coil spring 72 is compressed in FIG. 2, but it will elongate in FIG. 3, as will be described. The tool terminates at a tapped opening 74 at the very bottom for threaded connection to an installation or retrieval tool.

FIG. 3 shows the apparatus after operation. In FIG. 3, the sleeve 30 is in the down position. The sleeve is down, limited in downward travel by a shoulder 76 at the very bottom sub. The shoulder 76 limits travel. At the upper end, the shoulder 28 limits travel in that direction. The sleeve 30 is moved downwardly by inertial upset, typically achieved through a jarring operation which, itself, is a result of running the tool below a jar mechanism. One suitable brand of jar equipment is made by Spang and is believed to be well known in the oil field. In any case, the sleeve 30 has moved downwardly. At this juncture, the four bow springs operate as two separate pairs, and one of the two pairs will deflect outwardly, depending on freedom permitted by the sidepocket in the tubing string. In one instance, it will be one pair, and, at another time, the other pair will bow outwardly. As shown, the north and south bow springs are still clamped or otherwise held against protrusion. This is a result of the confinement that the tubing string imposes on the bow springs. To this end, the sleeve 30 has two sets of windows which are displaced lengthwise from one another. As shown in FIG. 2, the spring 58 is positioned adjacent to a window 62 which is high on the sleeve. By contrast, the spring 60 is positioned opposite a window which is somewhat lower on the sleeve.

In operation, inertial upset drives the sleeve downwardly. This positions the four windows opposite the four bow springs so that all four bow springs can protrude. The coil springs 52 and 72 force the second and third bow spring anchor mechanisms toward one another. This movement imparts a bowing action to all four bow springs. If unconstrained, all four springs will deflect outwardly. On the other hand, if they are restrained, only two of the four will deflect outwardly. Such outward deflection is shown for the springs 60 in FIG. 3. This movement has been accompanied by the downward movement of the second bow spring anchor mechanism. FIG. 3 shows the coil spring 52 elongated. This has moved the second bow spring anchor mechanism downwardly. As the coil spring 52 elongates, this downward movement supplies arc or curvature to the pair of bow springs.

By contrast, the other pair of bow springs are positioned immediately adjacent to windows which permit their protrusion, presuming there is sufficient freedom. The freedom is a result of constraints in the tubing string. This limits the bow springs. This, then, holds the bow springs clamped and forces the first and third bow spring anchor mechanisms further apart to flatten the springs between them. Since the upper, or first, anchor mechanism is fixed in location, only the third one can move. It is urged in the opposite direction by the spring 72, but clamping action of the two coil springs against the tool overcomes the compressive force of the spring 72. In other words, the spring 72 is compressed. It stays in the compressed state as long as the coil spring 58 is not free to bow outwardly.

As will be understood from the foregoing description, the four bow springs operate as two separate pairs, each pair being anchored to two different anchors, and they operate independently.

After the bow springs have flared outwardly, they can be easily compressed to the beginning position by simply pulling firmly upwardly on the tool. As the tool leaves the sidepocket, the bow springs are jammed against it, and the movable bow spring anchor mechanism connected at one end or the other telescopes away to permit such collapse.

The present invention is particularly useful in retrieving or installing gas-lift valves. The springs function somewhat as centering springs under constraint of the tubing string which surrounds the apparatus until a sidepocket is encountered. When one of the leaf springs falls into the sidepocket, the opposite of that spring will kick the lower end of the tool into the sidepocket. Moreover, the bow spring anchor mechanisms slide freely on the mandrel to accommodate flexure of the bow springs. This is a manner of achieving alignment by the flexure at the knuckle joint at the top end of the tool to easily position an installation or retrieval tool in the sidepocket for connection or disconnection of a gas-lift valve in the sidepocket. Retrieval of the kick-over tool of the present invention is accomplished by pulling on the wireline. The small, angular contact achieved on squeezing down the protruding bow springs readily overcomes the compressive force of the coil springs 52 or 72 and, thereby, enables the tool to be slimmed for passage through the tubing string.

While the foregoing is directed to the preferred embodiment, alterations and variations in the present invention may be incorporated without departing from the scope of the claims which are appended hereto.

I claim:

1. A kick-over tool for installing or removing apparatus is sidepockets in gas-lift wells which comprises:

(a) an elongate body;

(b) a first pair of oppositely disposed, centering springs on said body and adapted to bow outwardly for contact with a tubing string on placing the tool in a tubing string;

(c) a second pair of similar centering springs which are arranged oppositely of one another along said elongate body and wherein said first and second pairs comprise four springs which are arranged at about ninety degree intervals around said elongate body;

(d) lock means immobilizing said kick-over tool against kick-over, said lock means incorporating a telescoping sleeve about said body which has a locking position and an unlocking position wherein the unlocking position permits said centering springs to extend through a set of openings in said sleeve and wherein said openings alter the flexure of said springs between withdrawn or extended positions, said openings and said sleeve being constructed and arranged to releasably position said springs in the withdrawn or extended positions;

(e) means at the lower end of said elongate body adapted to be connected to an installation or retrieval tool; and (f) separate anchor means for said first and second pair of centering springs to enable them to function as separate pairs and wherein they jointly, as pairs, flex outwardly toward the extended position and further wherein, on constraint, the remaining pair of centering springs is withdrawn.

2. The apparatus of claim 1 wherein said openings on said sleeve are arranged in pairs, there being a first pair for said first centering springs and a second pair for said second centering springs, and wherein said openings are axially positioned along said sleeve to lock said first and second pairs of centering springs against said elongate body to provide a window adjacent to said centering springs which permits them to extend outwardly toward the extended position.

3. The apparatus of claim 1 wherein said springs connect at one end or the other to a circular, slidable anchor slidably mounted with respect to said elongate body at the upper or lower end of said centering springs and which centering springs are anchored at their respective upper or lower ends to said circular anchor means, said circular anchor incorporating a ring movable between two positions relative to said elongate body.

4. The apparatus of claim 1 including a swivel means at the upper end of said elongate body which includes a captured sphere within a nut having an axial passage, said passage having a tapered opening to define a range of deflection for said swivel means.

* * * * *